US006029847A

United States Patent [19]

Mahoney, Jr. et al.

[11] Patent Number: 6,029,847

[45] Date of Patent: Feb. 29, 2000

[54] INSULATING SACK FOR BEVERAGE CONTAINERS

[75] Inventors: Richard M. Mahoney, Jr., Westmont, N.J.; Daniel K. Lyons, Paoli, Pa.

[73] Assignee: Team Concepts, Inc., Collingswood, N.J.

[21] Appl. No.: 09/185,104

[22] Filed: Nov. 3, 1998

[51] Int. Cl.[7] ..... B65D 23/00

[52] U.S. Cl. ..... 220/739; 220/592.24; 220/903

[58] Field of Search ..... 220/739, 592.15, 220/592.16, 592.17, 592.23, 592.24, 903; D7/607

[56] References Cited

U.S. PATENT DOCUMENTS

| | | | |
|---|---|---|---|
| 1,949,677 | 3/1934 | Crawford | 220/592.14 X |
| 2,407,787 | 9/1946 | Kernahan . | |
| 2,435,921 | 2/1948 | Cronrath . | |
| 2,522,381 | 9/1950 | Kramer | 220/739 X |
| 2,610,757 | 9/1952 | Irvine | 220/592.24 X |
| 3,085,612 | 4/1963 | Gobel . | |
| 4,240,480 | 12/1980 | Strobel . | |
| 4,388,739 | 6/1983 | Martinon et al. . | |
| 4,401,245 | 8/1983 | Zills . | |
| 4,434,920 | 3/1984 | Moore . | |
| 4,573,204 | 2/1986 | Polett . | |
| 4,805,748 | 2/1989 | Gerch . | |
| 4,815,640 | 3/1989 | Johnson . | |
| 5,050,998 | 9/1991 | Wachtel . | |
| 5,381,922 | 1/1995 | Gladman et al. . | |
| 5,609,265 | 3/1997 | Haberkorn et al. | 220/903 X |
| 5,622,346 | 4/1997 | Story, Jr. . | |
| 5,634,576 | 6/1997 | Arbel . | |
| 5,692,660 | 12/1997 | Stewart . | |
| 5,915,580 | 6/1999 | Melk | 220/592.24 X |

*Primary Examiner*—Steven Pollard
*Attorney, Agent, or Firm*—Shoemaker and Mattare, Ltd

[57] ABSTRACT

An insulating sack for carrying beverages and other items includes an inner fabric bag having an open mouth and a closed bottom, an outer bag connected to the inner fabric bag along said mouth, means defining a first drawstring pathway adjacent said mouth, a first drawstring inserted along said pathway and having ends extending outside of the pathway whereby the first drawstring can be tightened to purse the mouth, and a second drawstring passing circumferentially around the inner bag and inside of the outer bag, whereby the second drawstring can be tightened to reduce the effective diameter of the inner bag at a position more than halfway from the mouth to the closed bottom of the outer bag, thus enabling one to custom-fit the sack to items of various sizes.

9 Claims, 8 Drawing Sheets

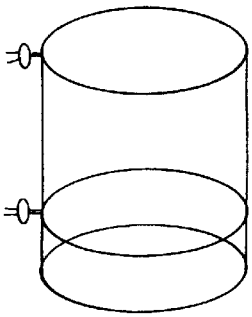
FIG.4a
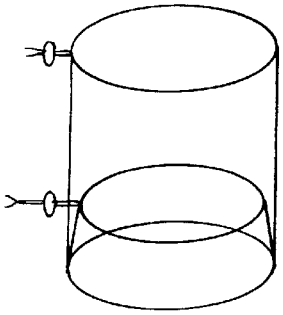
FIG.4b
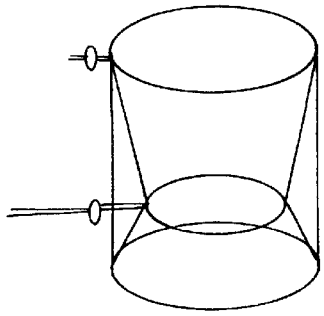
FIG.4c
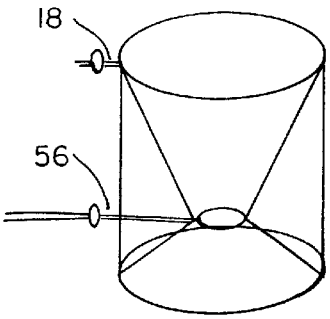
FIG.4d
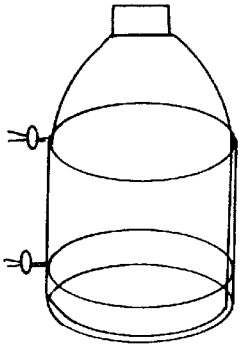
FIG.5a
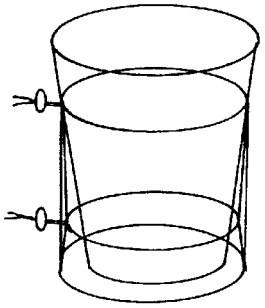
FIG.5b
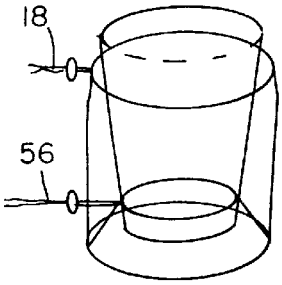
FIG.5c
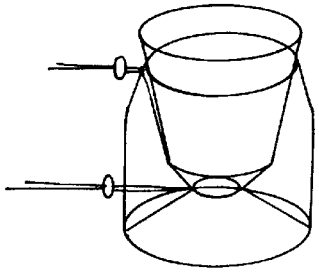
FIG.5d
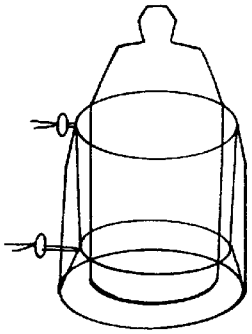
FIG.5e
FIG. 5f
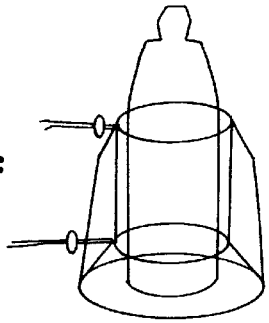
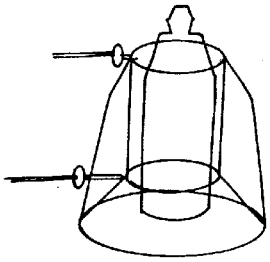
FIG.5g

INSULATING SACK FOR BEVERAGE CONTAINERS

BACKGROUND OF THE INVENTION

This invention relates to a carrier for beverage containers and other items.

The traditional thermos bottle has some notorious disadvantages (weight, hardness, breakability, difficulty in cleaning) that have led inventors to produce alternative softer devices for keeping beverages in cans or bottles cold or hot.

There are already a variety of insulated beverage carriers designed to hold a single can, cup or bottle of hot or cold liquid. An example are the insulating foam sleeves which can be placed around beer cans to keep them cold. One such sleeve is shown in U.S. Pat. No. 5,381,922.

Some prior beverage containers have been provided with carrying handles and the like. The sleeve shown in U.S. Pat. No. 5,381,922, for example, has a strip of Velcro material attached to it, so that the unit can be stuck to a fixture such as a belt clip having a complementary pad of Velcro. (Throughout this specification, the term "Velcro" is capitalized to indicate it is a trademark. The equivalent generic term "hook and loop fastener" is used as well.)

Some of prior beverage carriers are in the form of a sack or satchel. U.S. Pat. No. 4,401,245, for example, shows a collapsible, insulating beverage container carrier made of a quilted fabric material. One can tighten the mouth of the container around a beverage bottle neck by drawing together opposed Velcro straps. A pocket for other articles is attached to one side of the bag, and a carrying strap is attached to the other side.

While there are some beverage carriers which can be adjusted to hold containers of various sizes, some deformation of the exterior of the carrier typically occurs. Such deformation may obscure logos or printing on the outside of the carrier, and may also constrict any pockets or other accessories attached to the carrier. It would be better to provide a carrier whose interior size was adjustable, but in a way that did not affect the exterior of the carrier.

French Patent 2670187 discloses a bag for holding bottled beverages. Three draw strings at different levels on the bag allow one to evert the bag and thus form the mouth at one of the different levels, but the exterior appearance is affected because each of the draw strings runs around the outside of the bag.

SUMMARY OF THE INVENTION

An object of the invention is to improve the versatility of an insulating tote bag for beverages.

Another object is to provide a beverage carrier which can be adjusted to hold bottles and cups of different heights and diameters, and to do so without constriction or deformation of the exterior of the carrier, so that printed or embroidered matter on the outside surface remains easily readable, or to enable the addition of other features related to extending the utility of the sack (such as larger pockets, means for carrying or securing the sack, on so on).

These and other objects are attained by an insulating sack for carrying beverages and other items, as described below. The bag includes an inner fabric bag having an open mouth and a closed bottom, an outer bag connected to the inner fabric bag along said mouth, means defining a first drawstring pathway adjacent said mouth, a first drawstring inserted along said first pathway and having ends extending outside of the first pathway whereby the first drawstring can be tightened to purse the mouth, and a second drawstring passing circumferentially around the inner bag and inside of the outer bag, whereby the second drawstring can be tightened to reduce the effective diameter of the inner bag at a position more than halfway from the mouth to the closed bottom of the outer bag, thus enabling one to custom-fit the sack to items of various sizes.

An advantage of this invention is that it results in a layering effect which contributes to the insulating quality of the sack.

BRIEF DESCRIPTION OF THE DRAWINGS

In the accompanying drawings.

FIGS. 4*a*–4*d* show, diagramatically, how the sack size can be adjusted; and FIGS. 5*a*–5*g* illustrate various containers to which the sack may be adapted.

DESCRIPTION OF THE PREFERRED EMBODIMENT

Figure 1:
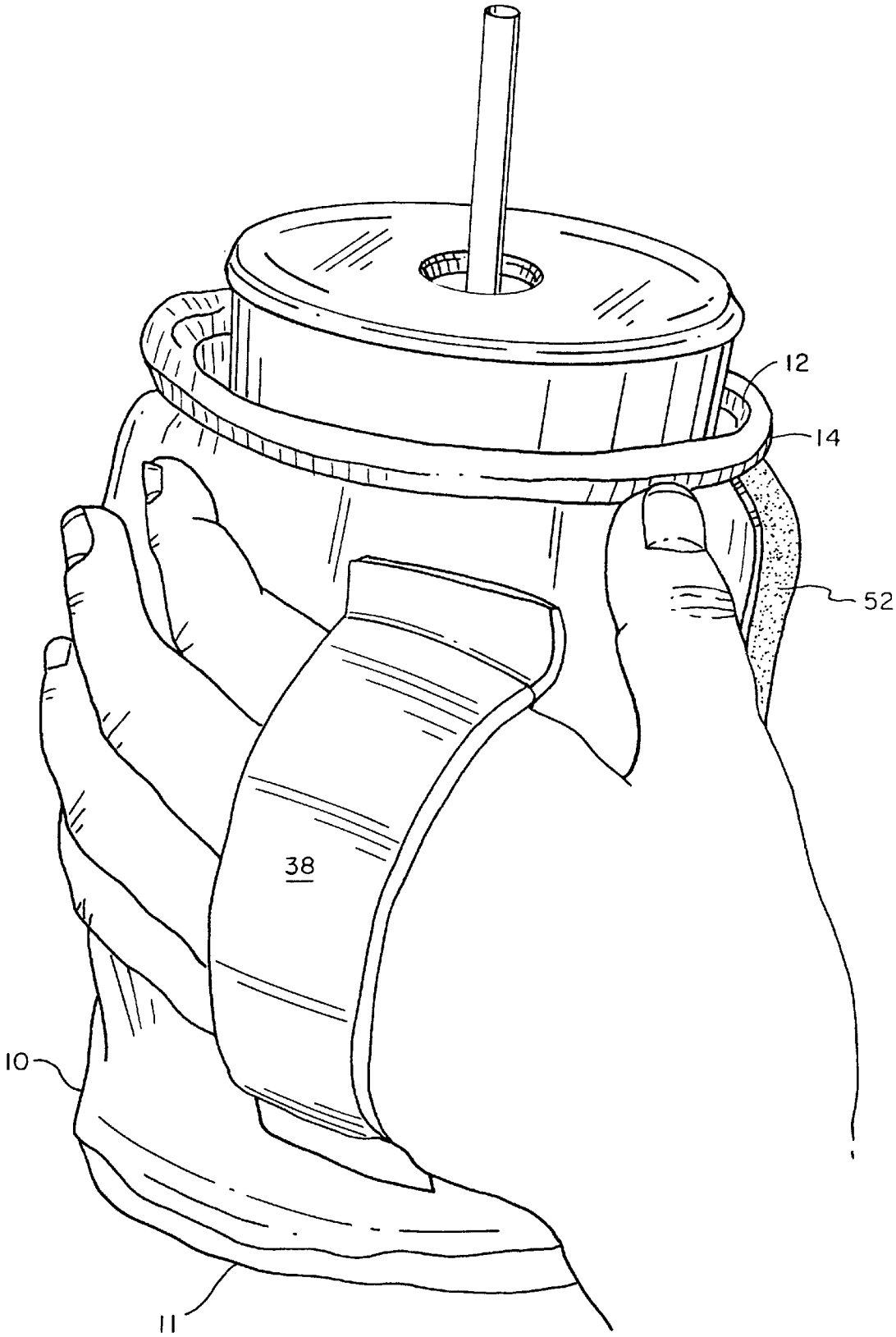
FIG. 1 is a perspective view, from the rear and above, of an insulating sack embodying the invention.
Figure 2:
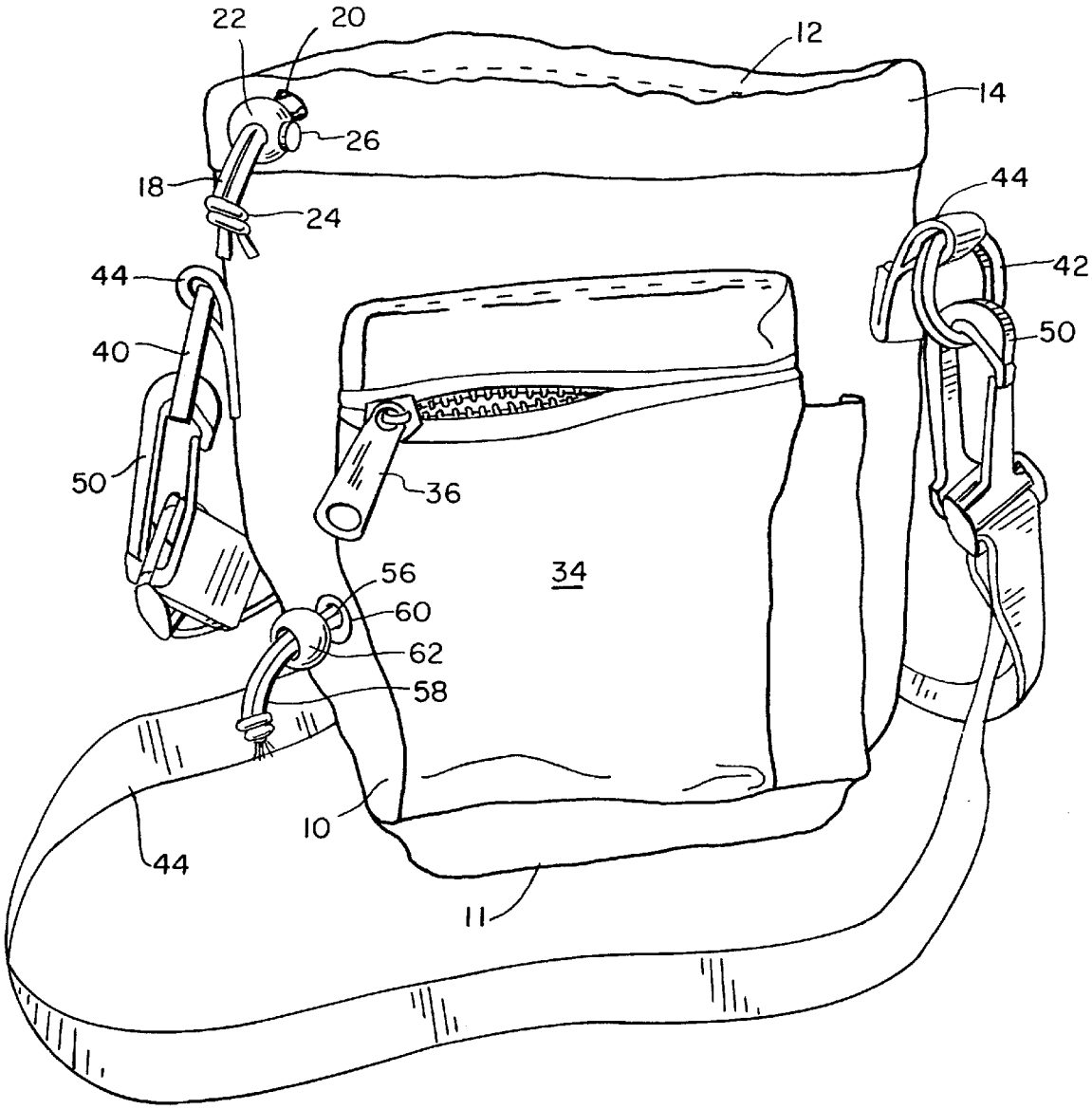
FIG. 2 is a front view thereof.
Figure 3:
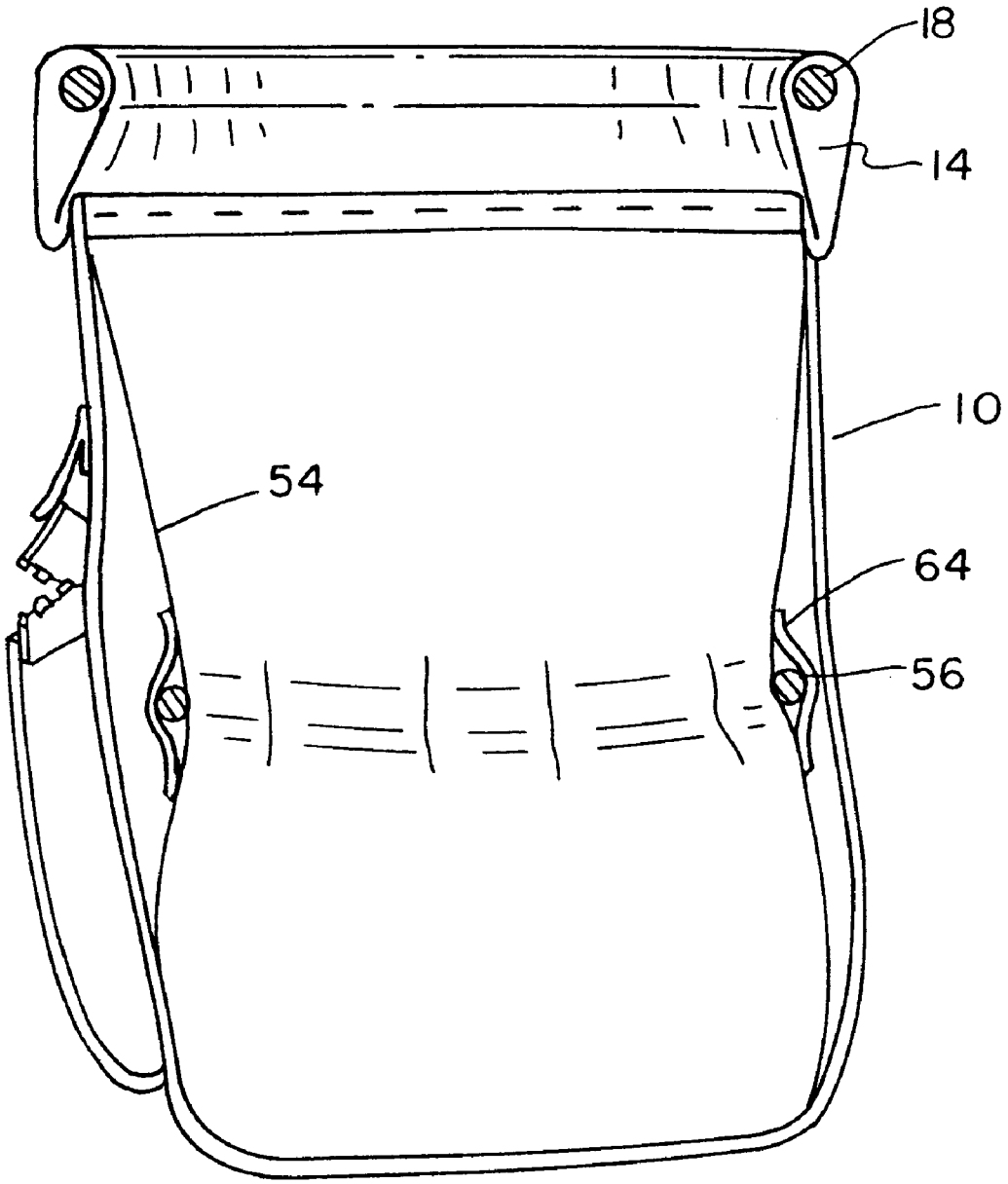
FIG. 3 is a sectional view taken on the line 3—3 in FIG. 2.

An insulating sack embodying the invention, as seen in FIGS. 1–3, comprises an outer bag 10 having a closed bottom 11 and an open mouth 12 at its upper end. Preferably, the outer bag is made of a fabric material such as 600 dernier nylon; however, other materials, even non-fabric materials such as leather, may prove suitable. A strip of light weight fabric material 14, folded lengthwise, is sewn along its free lateral edges to the outside of the bag, parallel to the mouth. A drawstring 18 (FIG. 2) is inserted into the pathway formed within the fold, each end of the drawstring protruding through a hole 20 left open when the ends of the strip meet. The ends of the drawstring are passed through a common "barrel lock" sliding clamp 22, and are then knotted (at 24) so that they will not pull back through the clamp. One can purse the mouth by tightening the drawstring and clamping the ends.

The preferred clamp 22 has a spherical plastic body, a longitudinal passage through which the drawstring ends pass, and a plunger 26 mounted in a blind bore transverse to the passage. A spring at the bottom of the bore biases the plunger outward to clamp the drawstring; this spring force can be overcome by pressing on the exposed end of the plunger 26.

An auxiliary pocket 34, for small items such as snacks, is sewn to the side of the outer bag. The pocket may be open at the top, or it may be closed at the top or along one side by a zipper 36 or similar fastener.

A handle strap 38 (FIG. 1) is sewn along the side of the bag, extending vertically between the bottom 11 of the bag to the mouth 12.

Additionally, two connector rings 40, 42 are secured to opposite sides of the bag, each by a short length of nylon webbing 44 passing through the ring and having both ends sewn to the bag material. A carrying strap 46 made of the same webbing, and having an adjustment ring slider 48, has latch hooks 50 at either end; these are snapped onto the rings when the carrying strap is needed.

A length 52 of hook-and-loop fastener material ("Velcro") is sewn, with the fastener side exposed, to one side of the outer bag, the length extending vertically from the bottom of the bag to the mouth. By mounting the complementary strip of fastener material (not shown) on a fixture, such as a vehicle or wall, one can conveniently attach the sack to a fixture temporarily. Adhesive-backed Velcro strips can be easily applied to such fixtures.

The pocket, handle strap, Velcro fastener and carrying strap are preferred features, but they are not necessary to the invention in its broadest sense.

As seen in FIG. 3, an inner fabric bag 54, preferably made of nylon fabric, is disposed within the outer bag. Only slightly smaller in size, the mouth of the inner bag is sewn to that of the outer bag along the mouth, possibly with the same stitches that secure the drawstring strip. Dead air trapped between the inner and outer bags provides thermal insulation. If more thermal resistance is desired, a layer of insulation (not shown)—such as 3M's "Thinsulate" foam insulation—may be inserted between the inner and outer bags.

A second drawstring 56 is inserted between the inner and outer bags, so that this drawstring, when tightened, constricts the inner bag, but not the outer one. Its ends 58 pass through a common eyelet 60 in the outer bag at a level closer to the bottom of the bag than to the mouth, and the ends are secured by a sliding clamp 62 as described above. A strip 64 of fabric or other material (FIG. 3) may be sewn around the inner bag to form a channel for the drawstring. Because the second drawstring does not engage the outer bag, it does not affect the appearance of the bag when it is tightened. FIGS. 4*a*–4*d* illustrate progressive tightening of the second drawstring. Functionally, the drawstring serves either to effectively raise the floor of the bag, or to tighten the inner bag around the beverage container, as one can see in FIGS. 5*a*–5*g*.

The lower drawstring allows one to adjust the sack for containers of various sizes. For example, a short coffee cup (FIG. 5*d*) may be placed in the bag after the lower drawstring has been drawn tight below the bottom of the bottle, effectively raising the floor of the sack so that the top of the cup protrudes slightly from the mouth of the sack. The top of the cup is then secured there by tightening the top drawstring. Alternatively, a tall container (FIG. 5*a*) may be placed in the sack without first tightening either drawstring, so that it rests on the bottom of the bag, and then one tightens both drawstrings around the bottle. For a container of intermediate height (FIG. 5*c*), one adjusts the lower drawstring to achieve the desired elevation of the container.

FIGS. 6–9 show examples of other forms of the invention, which illustrate that fact that the provision of inner and outer bags, unconnected except at their mouths, make it easy to add accessories such as pockets, carrying straps and so on to the outer bag, without affecting the function of the inner bag.

Figure 6:
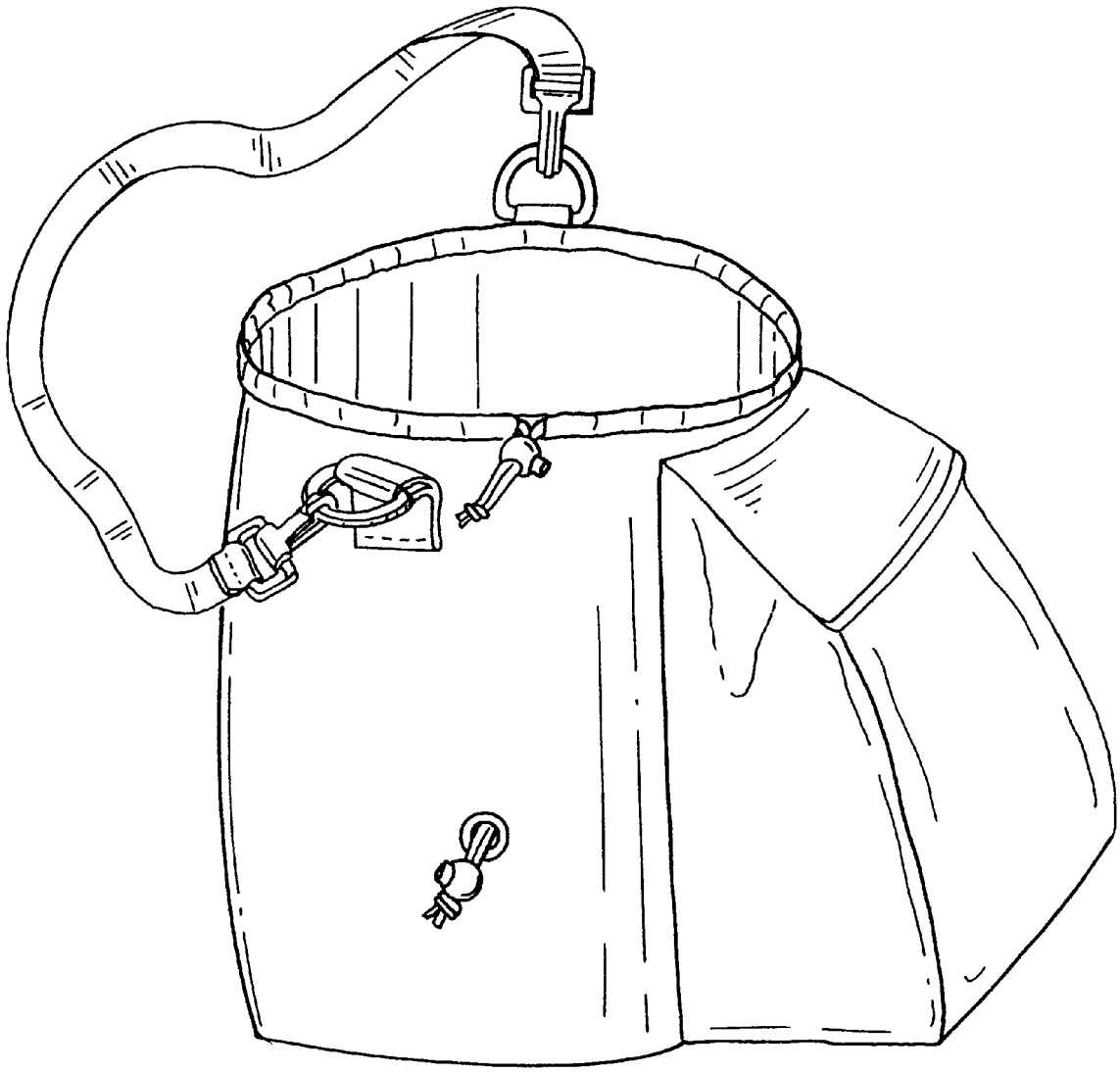
FIG. 6 is a perspective view of a second embodiment of the invention.

The sack illustrated in FIG. 6 has a large mouth, and a bag of considerable size, which may be used to carry sandwiches or other lunch items, is attached to the side of the sack.

Figure 7:
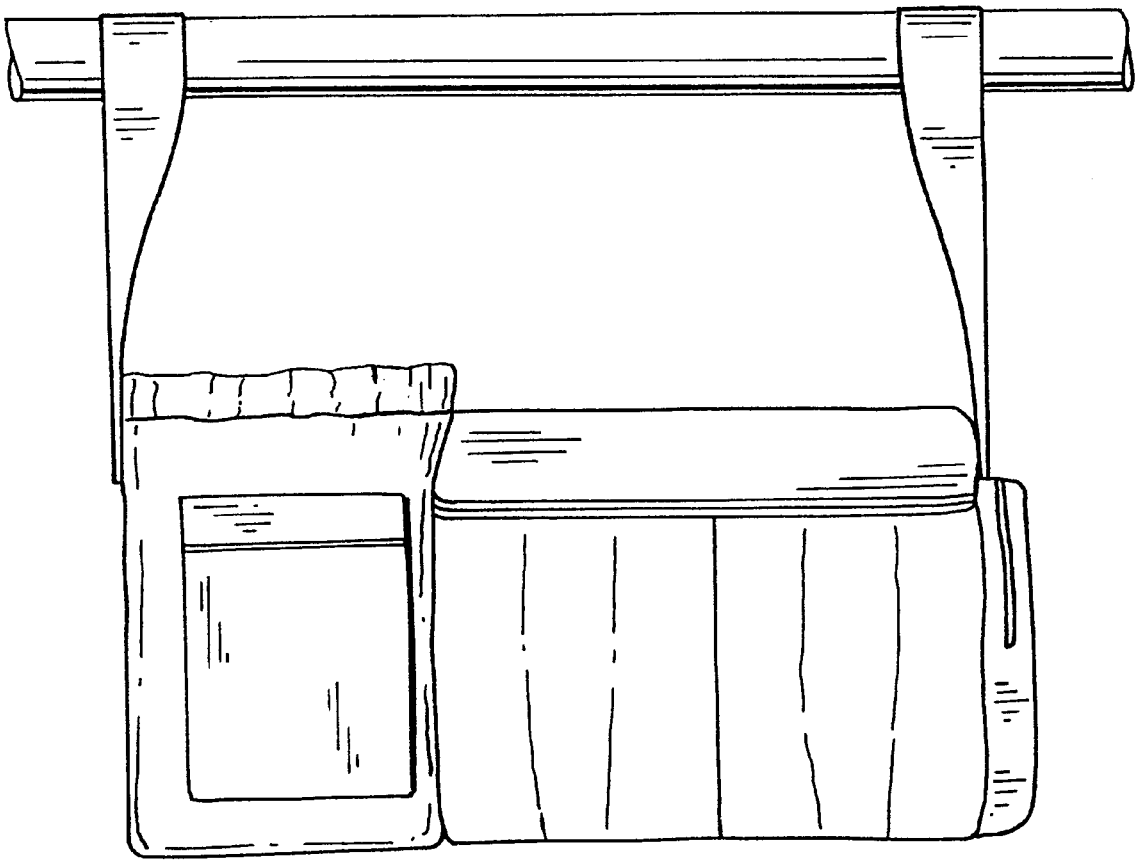
FIG. 7 is a front elevation of a third embodiment of the invention.

FIG. 7 shows a version of the invention having two large pockets interconnected along their edges. One of the pockets is also connected edgewise to a beverage sack as described previously.

Figure 8:
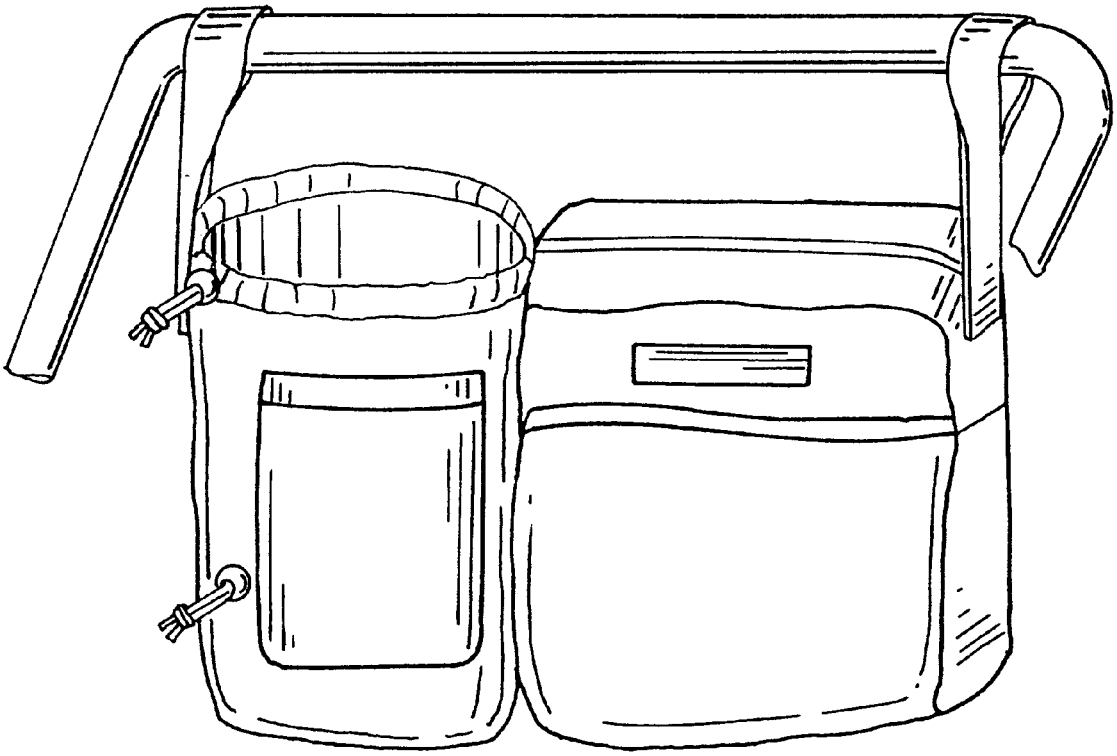
FIG. 8 is a front elevation of a fourth embodiment of the invention.

FIG. 8 illustrates a large stroller bag, suitable for carrying diapers, attached to the side of a beverage sack. Velcro-faced straps at either end of the unit can be attached over the handle of a stroller.

Figure 9:
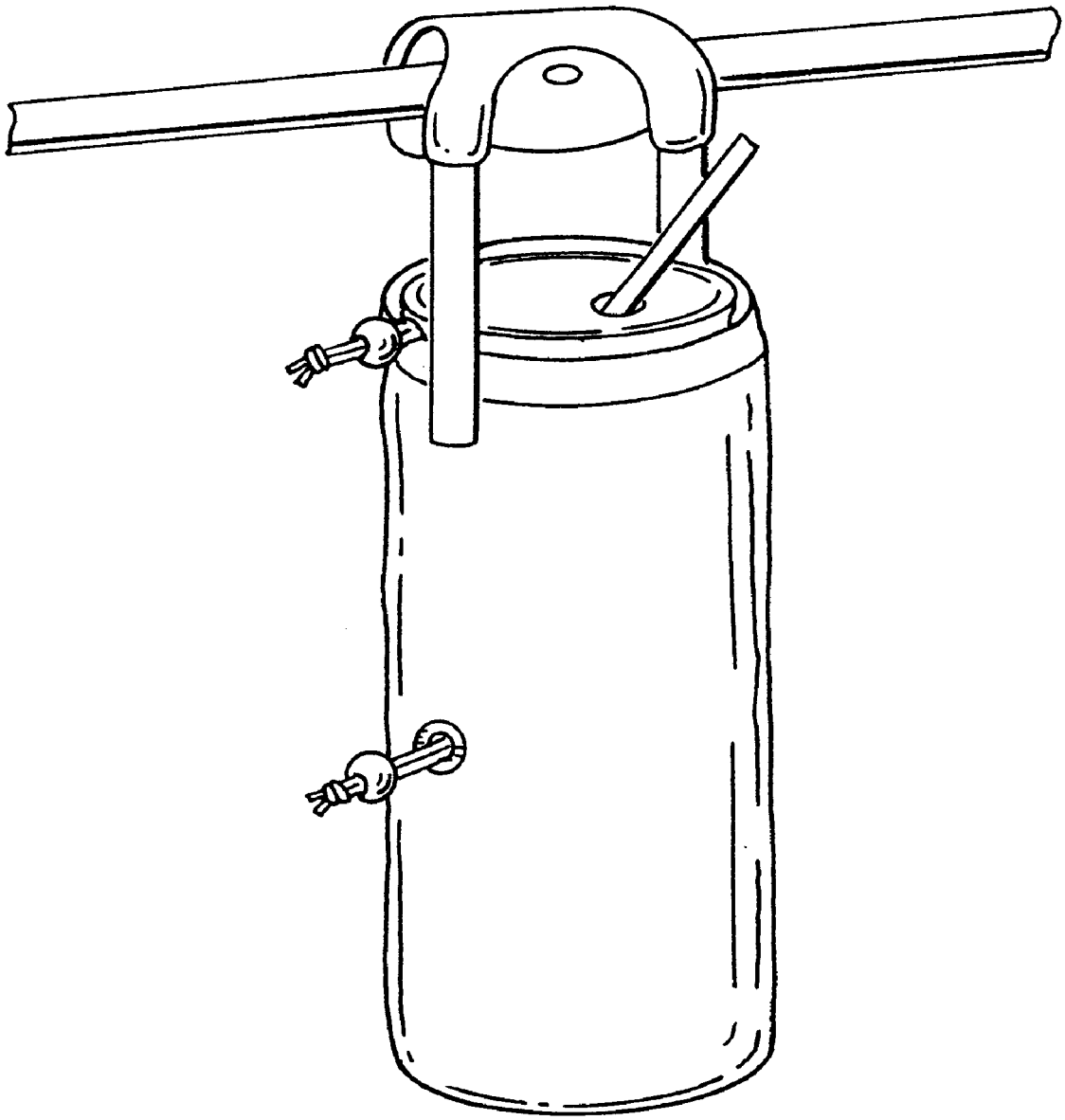
FIG. 9 is a perspective view of a fifth embodiment of the invention.

FIG. 9 shows a sack specifically designed to hold a baby bottle or a beverage can, and having a handle including a rigid hook or the like so that the unit can be hung from a railing or the like.

While the embodiments described above include only one intermediate drawstring, the principle of this invention may be realized in devices having more than one drawstring below the mouth. Also, while the description has been limited to round containers and bags, it should be understood that the invention is equally applicable to containers and bags having polygonal or other non-circular cross-sectional shapes.

Since the invention is subject to modifications and variations, it is intended that the foregoing description and the accompanying drawings shall be interpreted as only illustrative of the invention defined by the following claims.

We claim:

1. An insulating sack for carrying beverages and other items, said sack comprising an inner fabric bag having an open mouth and a closed bottom, an outer bag connected to the inner fabric bag along said mouth, means defining a first drawstring pathway adjacent said mouth, a first drawstring inserted along said first pathway and having ends extending outside of the first pathway whereby the first drawstring can be tightened to purse the mouth, and a second drawstring passing circumferentially around the inner bag and inside of the outer bag, whereby the second drawstring can be tightened to reduce the effective diameter of the inner bag at a position more than halfway from the mouth to the closed bottom of the outer bag, thus enabling one to custom-fit the sack to items of various heights and diameters, and to hold smaller containers so that their top edges remain above the mouth of the sack.

2. The invention of claim 1, further comprising a carrying strap having a connection at either end of the outer bag, but not to the inner bag.

3. The invention of claim 2, wherein the connection at either end of the outer bag comprises a ring secured to the outer bag, and a latch hook secured to a respective end of the strap.

4. The invention of claim 1, further comprising at least length of one hook and loop fastener secured to the outer bag, whereby the sack can be attached to a complementary strip of hook and loop fastener mounted on a fixture.

5. The invention of claim 1, further comprising at least one zippered pocket attached to the outer bag.

6. The invention of claim 1, further comprising at least one carrying strap attached to the outer bag.

7. The invention of claim 1, wherein each of said drawstrings further comprises a sliding clamp for holding both ends of the respective drawstring in a predetermined position.

8. The invention of claim 1, wherein the first pathway is formed by a strip of material folded lengthwise and sewn along its free lateral edges to the outer bag adjacent to and around said mouth.

9. The invention of claim 1, further comprising means defining a channel around the inner bag, through which the second drawstring passes.

* * * * *